US007254935B1

(12) United States Patent
Huang

(10) Patent No.: US 7,254,935 B1
(45) Date of Patent: Aug. 14, 2007

(54) RATCHET ARRANGEMENT FOR A CHAIN SPLITTER

(76) Inventor: Hong-Jhen Huang, No. 1-5, Guangfu Rd., Pitou Township, Changhua, 532 (TW)

( * ) Notice: Subject to any disclaimer, the term of this patent is extended or adjusted under 35 U.S.C. 154(b) by 0 days.

(21) Appl. No.: 11/460,264

(22) Filed: Jul. 27, 2006

Related U.S. Application Data

(63) Continuation-in-part of application No. 11/279,117, filed on Apr. 10, 2006.

(51) Int. Cl.
*B25B 13/00* (2006.01)
*B21L 21/00* (2006.01)

(52) U.S. Cl. ..... 59/7; 59/11; 81/57.3; 81/63.2; 7/138; 29/243.53

(58) Field of Classification Search ..... 59/7, 59/11; 81/57.3, 63.2; 7/138; 29/243.53
See application file for complete search history.

(56) References Cited

U.S. PATENT DOCUMENTS

| | | | | |
|---|---|---|---|---|
| 1,436,429 | A * | 11/1922 | Bean | 59/7 |
| 2,826,893 | A * | 3/1958 | Falk et al. | 59/7 |
| 2,895,289 | A * | 7/1959 | Wognum et al. | 59/7 |
| 5,140,736 | A * | 8/1992 | Hsiao | 29/243.54 |
| 5,251,341 | A * | 10/1993 | Seals | 7/138 |
| 5,603,247 | A * | 2/1997 | Wei | 81/63.2 |
| 6,832,531 | B1 * | 12/2004 | Marquardt | 81/57.3 |

* cited by examiner

*Primary Examiner*—David Jones
(74) *Attorney, Agent, or Firm*—Banger Shia

(57) ABSTRACT

A ratchet arrangement of a chain splitter comprises a rotating rod integrally formed at a side of the ratchet wrench, and the rotating rod is to be screwed in a threaded hole of a splitter body. The ratchet wrench can reduce the required revolving space and the whole packing of the chain splitter, thus saving the required space when transporting the packed chain splitter.

1 Claim, 4 Drawing Sheets

RATCHET ARRANGEMENT FOR A CHAIN SPLITTER

BACKGROUND OF THE INVENTION

1. Field of the Invention

The present invention relates to a ratchet arrangement for a chain splitter that is adapted for disconnecting a chain of a bicycle.

2. Description of the Prior Art

Please refer to FIG. 1, a conventional chain splitter for a bicycle chain is shown and comprises a rotating rod 11 installed at a side of a splitter body 1, and a rotating bar 12 is integrally formed with the rotating rod 11 and located at an end thereof, such that the rotating rod 11 and the rotating bar 12 form a T-shaped structure 13. In use, the user has to turn the rotating bar 12 360 degrees in order to push the rotating rod 11 to move, and then the displacement of the rotating rod 11 causes the positioning pin to move out of the bicycle chain. However, this conventional chain splitter still has the following disadvantages:

The rotating bar 12 of the splitter body 1 must be rotated continuously over 360 degrees, then the positioning pin can be pushed out of the inserting hole of the connecting plate of the chain. In addition to this, the T-shaped structure 13 formed by the rotating rod 11 and the rotating bar 12 substantially increases the size of the chain splitter, and the chain splitter requires a large transportation space.

The present invention has arisen to mitigate and/or obviate the afore-described disadvantages.

SUMMARY OF THE INVENTION

The primary objective of the present invention is to provide a ratchet arrangement for a chain splitter, wherein the chain splitter is compact for easy storage and transport, and the rotating rod can move axially with respect to the splitter body simply by turning the ratchet wrench a small angle.

To achieve the abovementioned objective, a threaded rod integrally formed at a side of a ratchet wrench is screwed in the threaded hole of the splitter body. Rather than rotating over 360 degrees, the ratchet wrench only rotates within a small angle, and substantially reduces the rotation-caused oscillation.

The present invention will be more clear from the following description when viewed together with the accompanying drawings, which show, for purpose of illustrations only, the preferred embodiment in accordance with the present invention.

DETAILED DESCRIPTION OF THE PREFERRED EMBODIMENT

The foregoing, and additional objective, features and advantages of the present invention will become apparent from the following detailed description of preferred embodiment thereof, taken in conjunction with the accompanying drawings.

Figure 1:
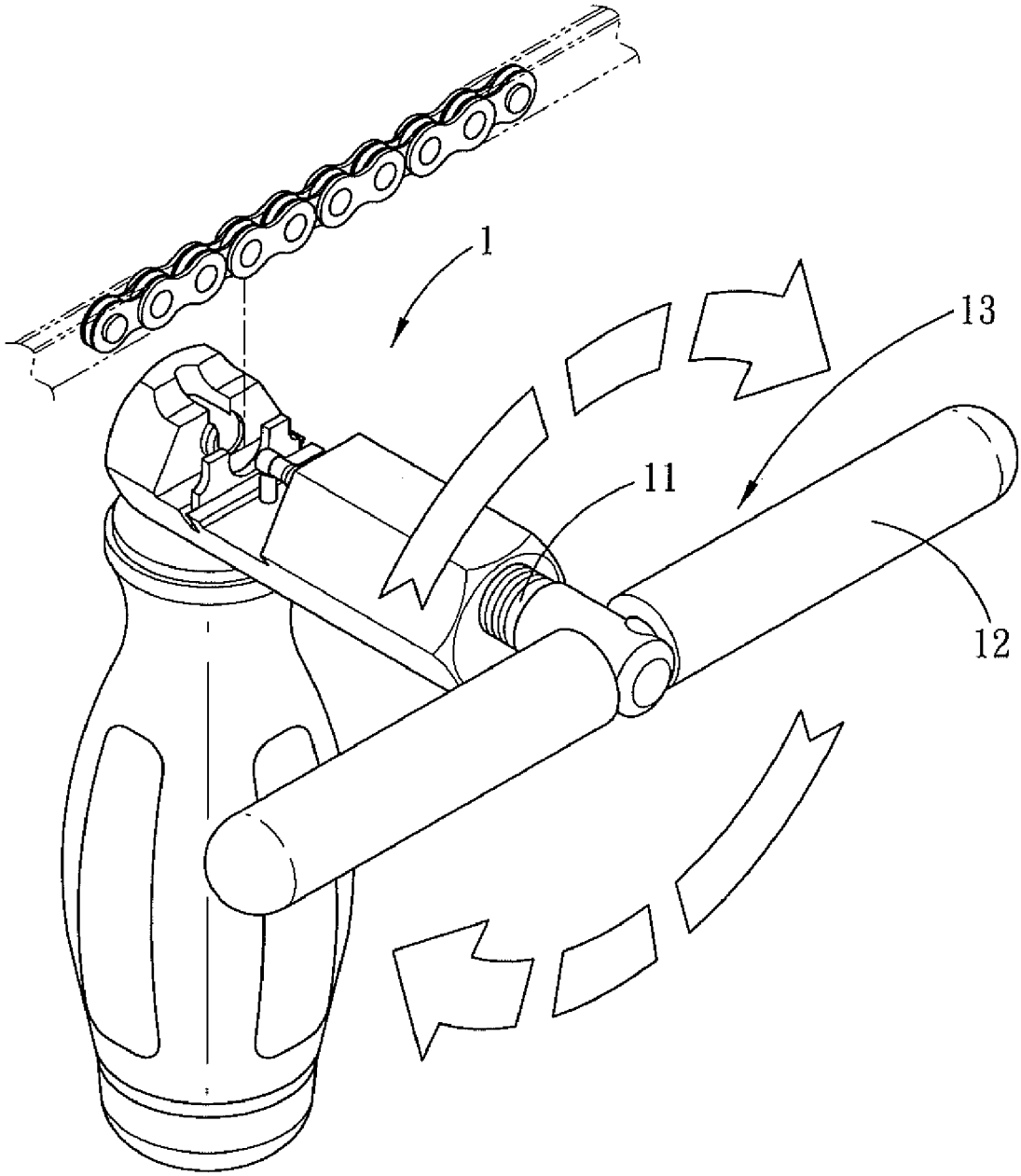
FIG. 1 PRIOR ART
FIG. 1 is a perspective view of a conventional chain splitter.
Figure 2:
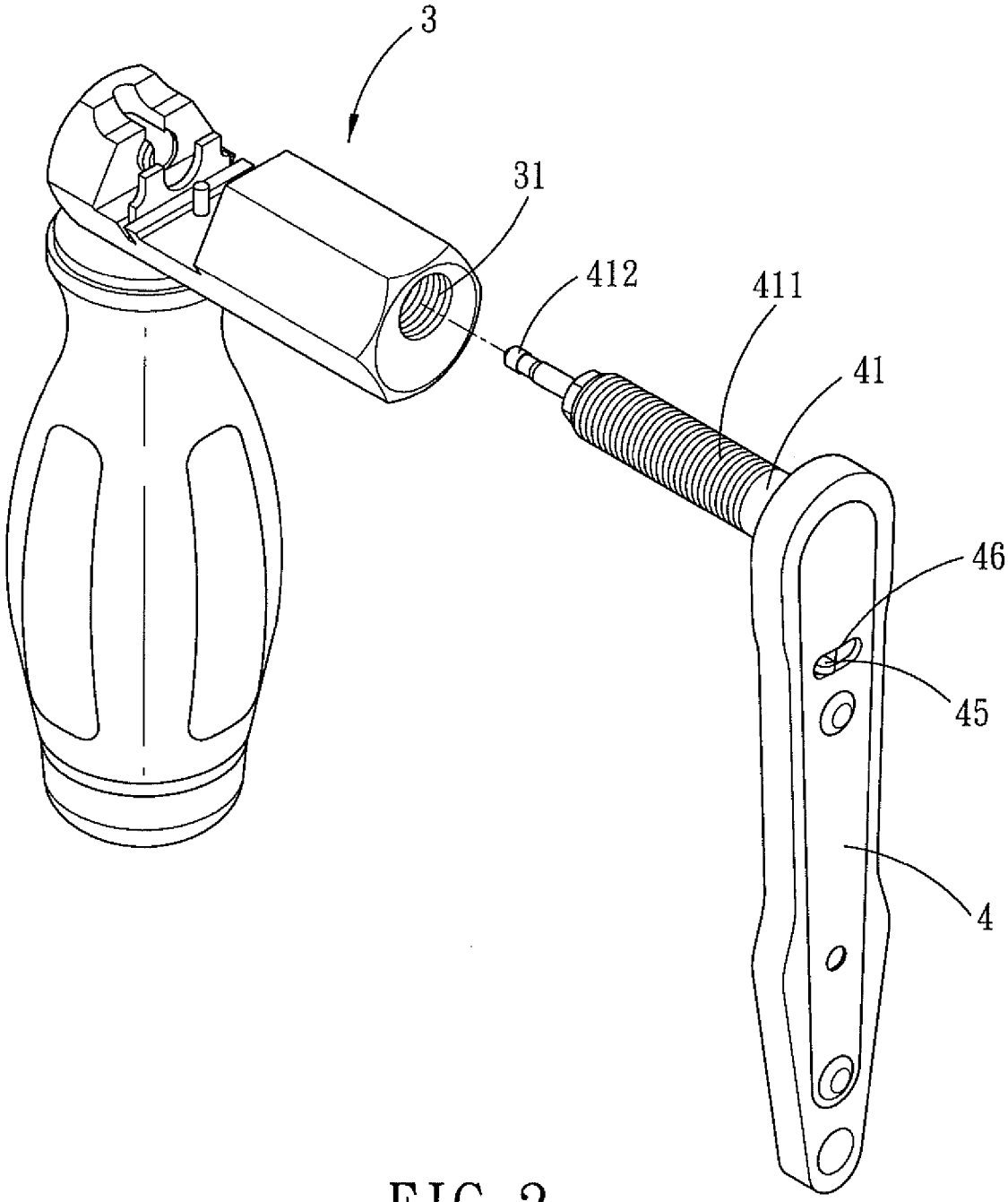
FIG. 2 is a perspective view of a chain splitter in accordance with a preferred embodiment of the present invention.
Figure 3:
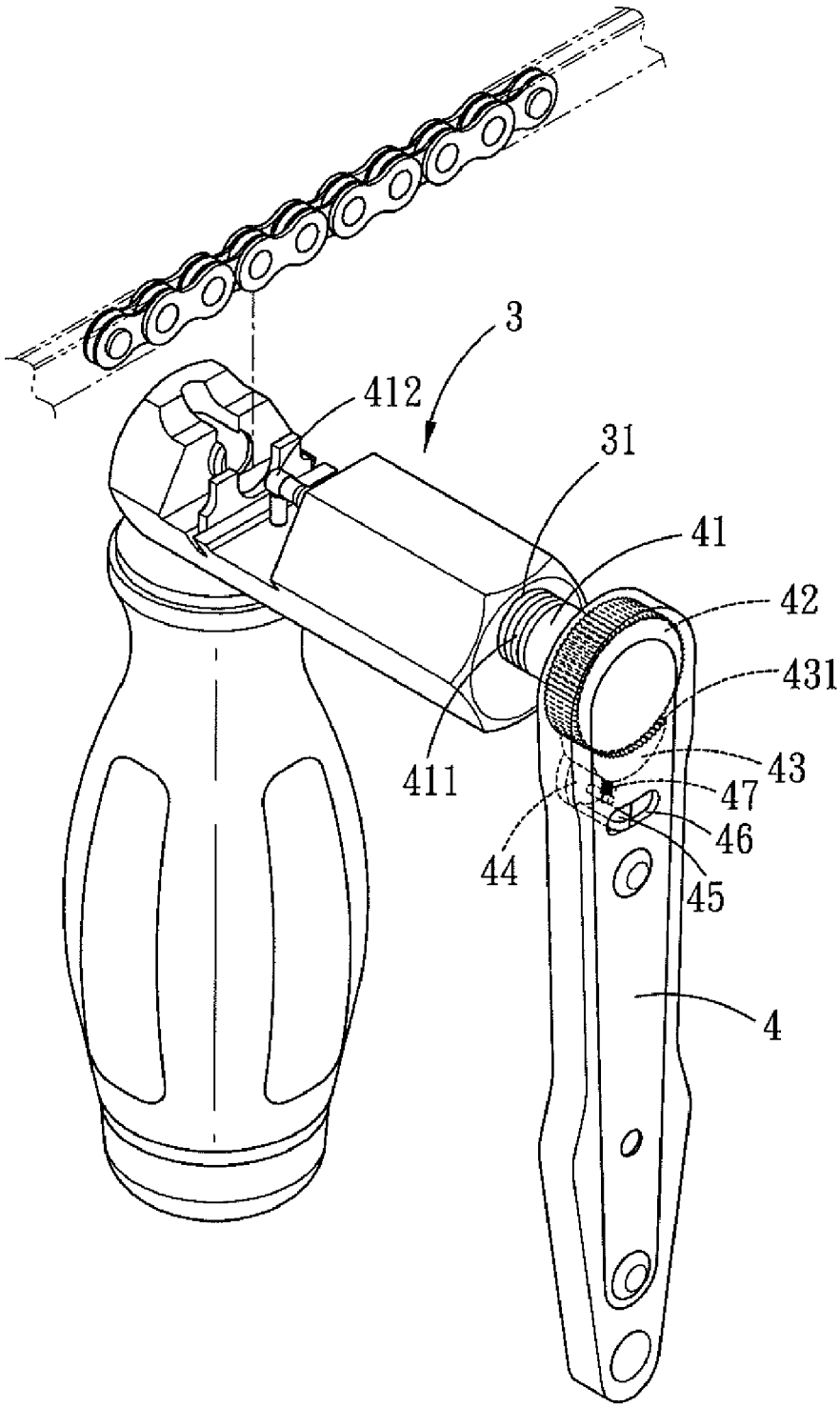
FIG. 3 is a partial perspective view of the ratchet arrangement for a chain splitter in accordance with the preferred embodiment of the present invention.
Figure 4:
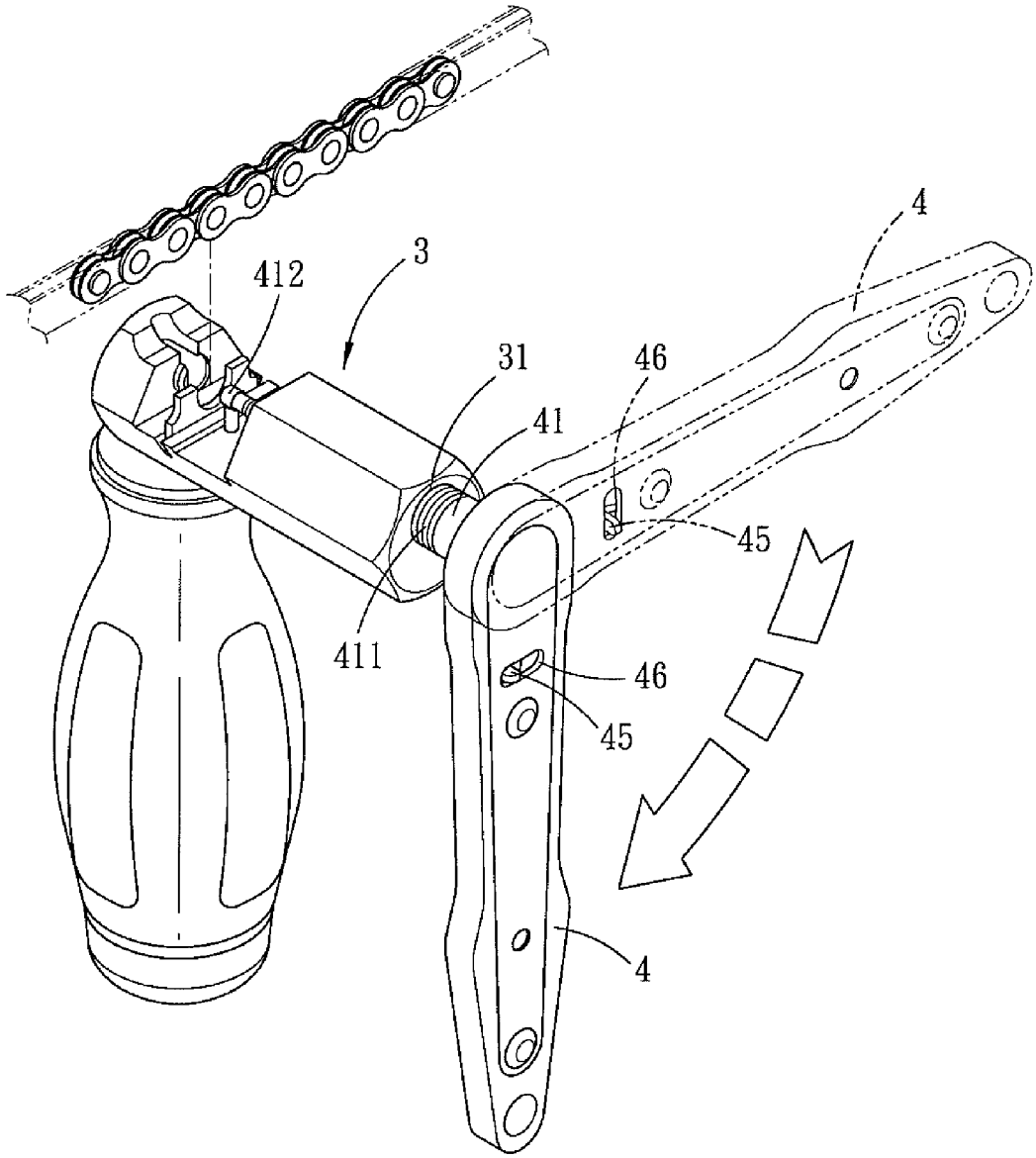
FIG. 4 is an operational view of the ratchet arrangement for a chain splitter in accordance with the preferred embodiment of the present invention.

Referring to FIGS. 2-4, a ratchet arrangement for a chain splitter for disconnecting a chain link in accordance with a preferred embodiment of the present invention is shown and comprises a splitter body 3 and a ratchet wrench 4.

The splitter body 3 is formed with a threaded hole 31.

The ratchet wrench 4 is integrally formed on a ratchet wheel 42 of the ratchet wrench 4, and a plurality of threads 411 is formed in the outer surface of the rotating rod 41 for enabling the rotating rod 41 to be screwed in the threaded hole 31 of the splitter body 3. The rotating rod 41 has one end integral with the body of the ratchet wrench 4, and the other end of the rotating rod 41 is a free end 412. By turning the ratchet wrench 4 within 90 degrees, the free end 412 of the rotating rod 41 will move axially with respect to the splitter body 3.

Referring then to FIG. 3, the ratchet wheel 42, a pawl 43, and a coupling member 44 are disposed in the ratchet wrench 4. The ratchet wheel 42 is integral with the rotating rod 41. An adjusting member 45 is formed at an end of the coupling member 44, an elongate hole 46 is formed in the ratchet wrench 4, and the adjusting member 45 protrudes out of the elongate hole 46 so that it can be controlled by the user. The coupling member 44 is connected with the pawl 43 by a spring 47. By moving the adjusting member 45 to the left or right, the pawl 43 can be engaged with the ratchet wheel 42 while moving the wrench in clockwise direction or in counterclockwise direction, respectively, so that the ratchet wheel 42 can be driven to rotate clockwise or counterclockwise by ratchet wrench 4. Since enabling the ratchet wheel to rotate in a bidirectional manner is a conventional technique in the art, further explanation is omitted.

Referring then to FIGS. 2 and 4, the rotating rod 41 is screwed in the threaded hole 31 of the splitter body 3, by turning the ratchet wrench 4, the rotating rod 41 will move back and forth within the threaded hole 31. Such arrangements allow the ratchet wrench 4 to swing more smoothly. Besides, when not in use, the ratchet wrench 4 can be disassembled from the splitter body 3 for easy storage and transport.

In addition, the rotating rod 41 of the ratchet wrench 4 can be engaged with a socket (not shown), and by turning the ratchet wrench 4 within a small angle, the rotating rod 4 will move axially.

While we have shown and described various embodiments in accordance with the present invention, it is clear to those skilled in the art that further embodiments may be made without departing from the scope of the present invention.

What is claimed is:

1. A ratchet arrangement for a chain splitter comprising:

a splitter body having a threaded hole; and a ratchet wrench; interiorly provided with a ratchet wheel, a pawl, and a coupling member; an adjusting member being formed on the coupling member, moving the adjusting member to the left or right can cause the coupling member to rotate the pawl, and consequently the paw is engaged with the ratchet wheel while moving the wrench in clockwise direction or in counterclockwise direction, respectively, a rotating rod having one end integrally formed with the ratchet wheel of the ratchet wrench, the other end of the rotating rod being a free end, a plurality of threads being formed on an outer surface of the rotating rod for enabling the rotating rod to be screwed into the threaded hole of the splitter body, by rotating the ratchet wrench repeatedly within a small angle, the ratchet wheel will be caused to rotate clockwise or counterclockwise, respectively, so that the rotating rod will move back and forth, and thus the free end of the rotating rod can move toward or away from a chain to be assembled or disassembled.

* * * * *